US008842866B2

(12) United States Patent
Christner

(10) Patent No.: US 8,842,866 B2
(45) Date of Patent: Sep. 23, 2014

(54) LOUDSPEAKER SYSTEM WITH REDUCED REAR SOUND RADIATION

(75) Inventor: Matthias Christner, Ludwigsburg (DE)

(73) Assignee: D&B Audiotechnik GmbH, Backnang (DE)

( * ) Notice: Subject to any disclaimer, the term of this patent is extended or adjusted under 35 U.S.C. 154(b) by 1500 days.

(21) Appl. No.: 12/000,104

(22) Filed: Dec. 7, 2007

(65) Prior Publication Data

US 2008/0137894 A1 Jun. 12, 2008

(30) Foreign Application Priority Data

Dec. 8, 2006 (DE) ..... 10 2006 058 009

(51) Int. Cl.

| | |
|---|---|
| ***H04R 1/20*** | (2006.01) |
| ***H04R 1/02*** | (2006.01) |
| ***H04R 1/32*** | (2006.01) |
| *H04R 1/28* | (2006.01) |
| *H04R 1/40* | (2006.01) |

(52) U.S. Cl.

CPC ..... *H04R 1/323* (2013.01); *H04R 1/2819* (2013.01); *H04R 1/2842* (2013.01); *H04R 1/403* (2013.01)

USPC ..... 381/345; 381/349; 381/351; 381/182; 381/71.1; 381/71.7; 381/71.8; 381/73.1

(58) Field of Classification Search

USPC ..... 381/345, 71.1, 349, 351, 182, 71.7, 381/71.8, 73.1

See application file for complete search history.

(56) References Cited

U.S. PATENT DOCUMENTS

| | | | | | |
|---|---|---|---|---|---|
| 2,689,016 | A | * | 9/1954 | Lang | 181/145 |
| 4,549,631 | A | * | 10/1985 | Bose | 181/155 |
| 4,694,497 | A | * | 9/1987 | Kasai et al. | 381/63 |
| 5,073,945 | A | * | 12/1991 | Kageyama et al. | 381/89 |
| 5,588,065 | A | * | 12/1996 | Tanaka et al. | 381/96 |
| 6,389,146 | B1 | * | 5/2002 | Croft, III | 381/345 |
| 2005/0178511 | A1 | * | 8/2005 | Sala | 160/368.1 |
| 2005/0178611 | A1 | * | 8/2005 | Noselli et al. | 181/145 |

FOREIGN PATENT DOCUMENTS

| | | | | |
|---|---|---|---|---|
| DE | 975 222 | | 10/1961 | |
| JP | 3-66296 | * | 3/1991 | H01R 1/40 |
| WO | 01/62043 | A1 | 8/2001 | |
| WO | 2004/002190 | A1 | 12/2003 | |

OTHER PUBLICATIONS

Chinese Office Action issued on Oct. 9, 2010 in corresponding Chinese Patent Application 200710195041.0.

Thomas Holmes, The "Acoustic Resistance Box" a Fresh Look At an Old Principle, J. Audio Eng. Soc., vol. 34, No. 12, Dec. 1986, pp. 981-989.

* cited by examiner

*Primary Examiner* — Tom Thomas
*Assistant Examiner* — Benjamin Tzu-Hung Liu
(74) *Attorney, Agent, or Firm* — Staas & Halsey LLP

(57) ABSTRACT

A loudspeaker system has a front loudspeaker enclosure (30) having at least one first loudspeaker (20) and a rear loudspeaker enclosure (50) having at least one second loudspeaker (60). The rear loudspeaker enclosure (50) is in the form of a bandpass enclosure.

21 Claims, 4 Drawing Sheets

LOUDSPEAKER SYSTEM WITH REDUCED REAR SOUND RADIATION

The invention relates to a loudspeaker system with rearward sound suppression and particularly to a bass loudspeaker system of this kind.

Bass loudspeaker systems typically have only very low directivity. This is because for a sound source to have useable directivity it needs to have dimensions which correspond at least to the wavelength which is to be radiated. The audio frequency band extends roughly from 20 Hz to 20 kHz, corresponding to wavelengths of 17 m to $1.7\times10^{-2}$ m. The typical operating range of low-frequency loudspeaker systems (also referred to as subwoofer systems) is roughly 35 Hz to 120 Hz. This corresponds to a wavelength of 10 m to 3 m. Hence, effective directivity both in the horizontal and in the vertical plane is achieved only by very broad and tall bass loudspeaker arrangements, which are usually designed in the form of an array comprising a plurality of bass loudspeaker systems.

Increased directivity of loudspeaker systems affords various advantages. Generally, increased directivity allows reduced sound emission in unwanted directions. This is of increasing importance in respect of noise prevention, particularly in the case of open-air events, e.g. open-air concerts.

A further advantage which is likewise of special relevance for public address systems for large-space or open-air events is that the level behind the loudspeaker system is significantly reduced by improved directivity. This significantly lessens its interfering influence in the rearward area on the stage. Consequently, higher maximum gain before feedback is achievable.

Furthermore, increased directivity in closed spaces reduces the diffuse sound in the bass range, and the acoustic room modes are excited significantly less. The improved ratio of diffuse sound to direct sound in the systems' radiation area makes bass reproduction significantly more precise.

Several approaches are already known which can be used to improve the directivity of sound sources. A first option is to use bipolar loudspeakers. Bipolar loudspeakers work with open rear chambers or effectively open rear chambers (such as a U-shaped or H-shaped enclosure) and output the acoustic energy in opposite phases at the front and back. Their system-related severe level drop at low frequencies means that they are of no great importance for public address engineering (large-space or open-area public address systems) and are used chiefly in home hi-fi applications.

A second option is to radiate the sound energy radiated into the enclosure volume from the rear of the loudspeaker's diaphragm via defined acoustic impedances through rear openings in the enclosure. The capacitive behaviour of the internal air volume together with the resistive behaviour of the acoustic impedance form an audio low-pass filter which, with suitable proportioning, produces the required transfer function for the rear sound radiation. A problem in this context, however, is selecting the acoustic resistance material with the suitable properties in the required frequency range. Therefore, the production of directivity through damped rear openings is applied primarily in the audio midrange, in which suitable acoustic resistance materials are available.

A third option for obtaining directional sound radiation is to use a second sound source at a defined distance behind the first sound source in order to cancel the sound radiated to the rear by the first sound source. The use of a second sound source allows high directivity to be achieved without large loudspeaker arrays, even at low frequencies. Such bass loudspeaker systems are also referred to as cardioid subwoofer systems on account of their heart-shaped radiation characteristic in the polar diagram. So that the desired cancellation of the sound components behind the loudspeaker system is attained over the entire desired operating range of the loudspeaker system, the phase response and level profile of the rear sound source need to be adjusted using suitable measures. This requires a combination of signal delay, phase and frequency response equalization for driving the rear sound source opposite the front sound source. In practice, this requires a dedicated power amplifier channel for the rear sound source. One drawback, inter alia, is the complexity this requires.

The invention is based on the object of providing a loudspeaker system which exhibits directional sound radiation. In particular, the directivity is meant to be easily achievable and to allow the high levels required in public address engineering.

The object on which the invention is based is achieved by the features of the independent claims. Advantageous refinements and developments of the invention are specified in the subclaims.

In accordance with claim 1, a loudspeaker system comprises a front loudspeaker enclosure having at least one first loudspeaker and a rear loudspeaker enclosure having at least one second loudspeaker. In this case, the rear loudspeaker enclosure is a bandpass enclosure.

The invention is based on the consideration of attaining the necessary transfer response for the rear sound source relative to the front sound source using a suitable acoustic resonator for the rear sound source. The transfer function (audio bandpass) produced by a bandpass enclosure has a transmission range which is limited in the direction of increasing frequencies by an audio low-pass filter. As explained in more detail below, an audio low-pass filter allows extensive cancellation of the sound radiated to the rear in the rear sound source's transfer function (frequency response) and hence the production of a cardioid or hypercardioid radiation pattern.

If the rear loudspeaker enclosure is an at least double-vented bandpass enclosure, it is possible to attain a sixth-order bandpass filter, for example, with a corresponding low-pass response in the region of the upper band limit. Alternatively, it is also possible for the rear loudspeaker enclosure to be a single-vented bandpass enclosure. Single-vented bandpass enclosures produce a response corresponding to a fourth-order bandpass filter and likewise allow the sound radiated to the rear to be attenuated or cancelled by utilizing the audio low-pass response of such a bandpass filter in the region of the upper band limit.

The front loudspeaker enclosure may be a high-pass enclosure. A vented high-pass enclosure (bass reflex resonator) produces a fourth-order audio high-pass filter, while a closed high-pass enclosure implements a second-order audio high-pass filter. In principle, it is also possible for the front loudspeaker enclosure to be a bandpass enclosure, in which case the upper band limit needs to be moved towards higher frequencies than in the case of the rear bandpass enclosure, however.

The invention is explained by way of example below using exemplary embodiments with reference to the drawings, in which.

Figure 1:
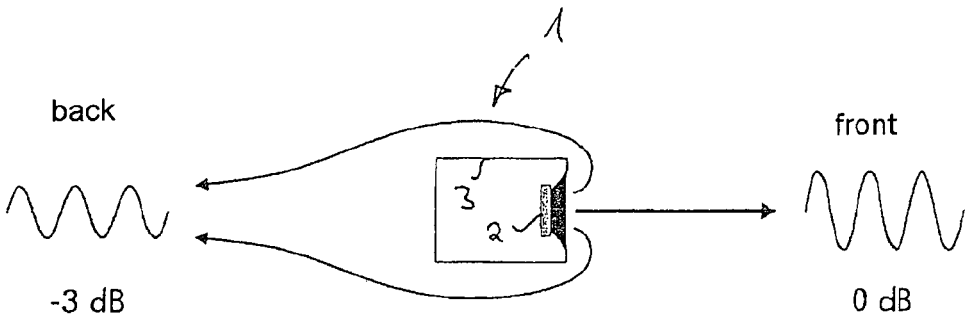
FIG. 1 shows a schematic illustration to explain the rearward sound attenuation for a sound source.

First of all, FIG. 1 will be used to explain why the rear frequency response of a sound source appears low-pass filtered relative to the front frequency response.

FIG. 1 shows a low-frequency sound source (subwoofer) 1 which has a bass loudspeaker (also referred to as bass driver) 2 incorporated in an enclosure 3 which is closed at the rear. In general terms, the rearward attenuation can be observed in any loudspeaker system in which a loudspeaker 2 is incorporated in an enclosure 3 closed at the rear and therefore becomes the audio monopole radiator. The rearward attenuation is the difference between the level (in decibels) at the rear and the level (in decibels) at the front of the sound source 1. For a given size of sound source (i.e. a given enclosure size), the attenuation is frequency dependent. The higher the frequency, the greater the attenuation. The attenuation is produced by virtue of the dimensions of the sound-radiating area (loudspeaker 2) drawing closer to the wavelength as frequency increases, and hence greater focusing of the radiated sound occurring at the front. Since increasing frequency focuses sound increasingly at the front, it is radiated backwards less as frequency increases. As a result, the rear frequency response of the radiation source 1 appears low-pass filtered relative to the front frequency response of the radiation source 1.

Figure 2:
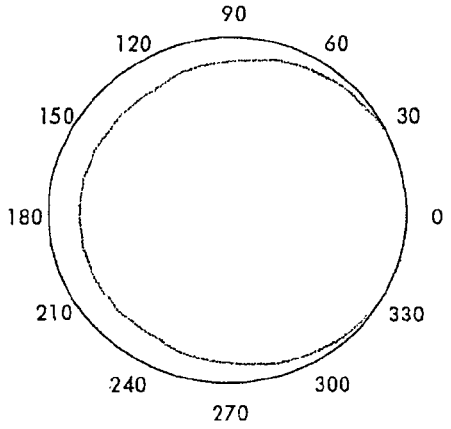
FIG. 2 shows a polar diagram to illustrate the rearward attenuation.

In the case of single enclosures 3, the attenuation in the bass range at the rear is very low. For a typical 18" loudspeaker system, it is approximately −3 dB at 70 Hz. Larger arrangements comprising an array of loudspeaker systems have greater directivity. An arrangement comprising three typical 18" subwoofers produces rearward attenuation of approximately −5 dB, as shown in the polar diagram shown in FIG. 2.

The principle of extensive cancellation of the sound radiated to the rear by a second, low-frequency sound source is based on the rear sound source cancelling the sound radiated to the rear by the front sound source by producing a sound field in phase opposition in the rear region of the loudspeaker system. In terms of an example, the rear sound source "waits" for the sound arriving from the front sound source in order to cancel it "when it arrives". At the cancellation point, there must therefore be a propagation time delay in the sound radiated by the rear sound source relative to the sound radiated in the rearward direction by the front sound source which corresponds to a phase difference of 180°.

It follows from the above that two conditions need to be satisfied for the rearward sound from the sound source 1 to be cancelled by a second sound source radiating in the rearward direction. First, the rear sound source must have an amplitude/frequency response in the form of low-pass filtering. If it did not have an amplitude/frequency response of this kind, the level profile of the sound radiated by the rear sound source 1 would not match the level profile of the rearward sound from the front sound source 1. Secondly, the propagation time delay of the rear sound source must be set such that the two sound fields come to be in phase opposition at a desired cancellation location.

Figure 3:
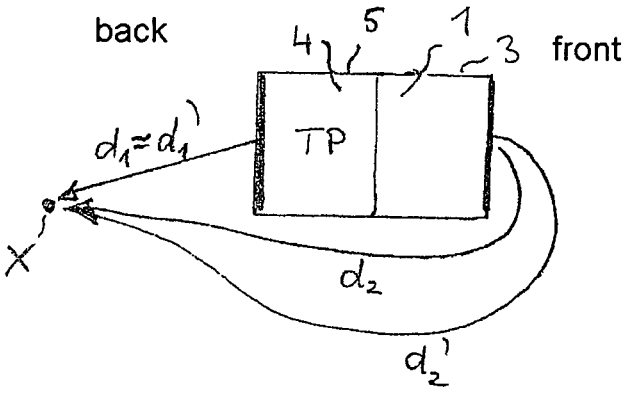
FIG. 3 shows a schematic basic illustration to explain the cancellation of the rearward sound from a first sound source by a second sound source.

In line with the invention, both conditions can be implemented by choosing a suitable acoustic enclosure (acoustic resonator) for the sound source radiating at the rear. FIG. 3 schematically illustrates the basic design of an inventive loudspeaker system having a first, front sound source 1 and a second, rear sound source 4. The first sound source 1 has an enclosure 3 and the second sound source 4 has an enclosure 5. The second sound source 4, which is provided for cancelling the rearward sound from the first sound source 1, has a low-pass amplitude response. This is achieved entirely or at least partly (see FIG. 8) by audio filtering by means of the enclosure 5 of the second sound source 4. Suitable choice of the physical properties of the second sound source (e.g. enclosure type, enclosure dimensions etc.), which define the audio filter, allow the low-pass amplitude response of the second sound source 4 to be adjusted to suit the low-pass amplitude response of the rearward sound from the first sound source 1, which results in cancellation of the rearward sound from the first sound source 1 in a desired region behind the loudspeaker system 1, 4. Typically, the sound sources 1, 4 are low-frequency sound sources, but the invention may also be used in the audio midrange and, in principle, in all frequency ranges.

The way in which the inventive loudspeaker system works is explained in qualitative fashion with reference to FIGS. 3, 4, 5A and 5B.

Figure 4:
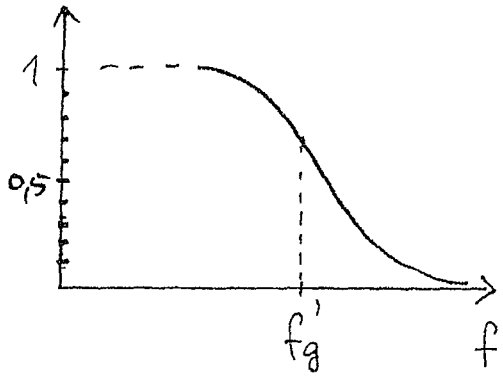
FIG. 4 shows a graph showing the frequency response of the rearward sound from the first sound source.

FIG. 4 shows the frequency response of the rearward sound from the first sound source 1, normalized to the sound amplitude in the passband. As already explained, said frequency response is low-pass filtered on account of the directivity of the first sound source 1 which increases as frequency rises. $f'_g$ denotes the cut-off frequency of the low-pass characteristic curve for the rearward sound radiation.

Figure 5A:
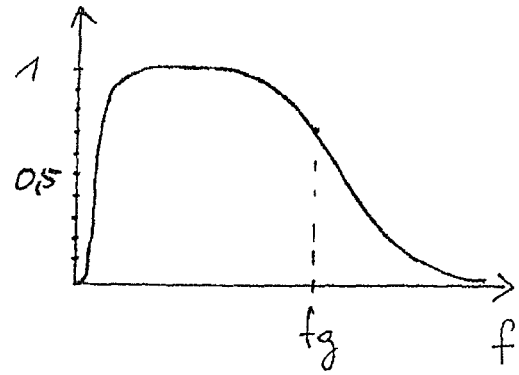
FIG. 5A shows a graph showing the frequency response of a bandpass resonator with a low-pass response for cancelling the rearward sound.

FIG. 5A shows an example of the frequency response of the second sound source 2, radiating to the rear. Choice of a suitable loudspeaker enclosure 5 means that the frequency response has a low-pass response at high frequencies. By way of example, both fourth-order and sixth-order bandpass enclosures have a second-order low-pass filter (they differ only in their high-pass response). $f_g$ denotes the cut-off frequency of the low-pass characteristic curve. Optimally, the low-pass response of the second sound source 4 corresponds to the low-pass response of the-rearward sound from the first sound source 1. That is to say that the characteristic curves shown in FIGS. 4 and 5A should have similar or identical characteristics for the order of the low-pass filter and/or the position of the cut-off frequencies ($f'_g \sim f_g$) The effect achieved by this is that the rear, second sound source 4 needs to cancel less unwanted sound components in the required manner as frequency increases. In other words, the frequency response alignment produces the requisite level compensation behind the loudspeaker system 1, 4.

As already mentioned, it is also necessary to ensure the condition for the propagation time delay (half period duration) at the desired cancellation location X. At a prescribed cancellation location X, the propagation time delay which arises there is influenced by a plurality of variables. First, the distance between the two sound sources 1, 4 is significant. The greater this distance, the longer the rearwardly directed sound source 4 has to "wait" for the arrival of the rearward sound from the first sound source 1.

A second influencing variable is the geometry or proportioning of the loudspeaker enclosure 3, 5. In the case of large-volume loudspeaker enclosures 3, 5, the rearward sound has to travel further than in the case of small-volume loudspeaker enclosures 3, 5, or those which have smaller proportions.

A third influencing variable is the frequency. For low frequencies, the effective travel around the loudspeaker system 1, 4 is longer than for higher frequencies. In terms of an example, low frequencies travel on a larger arc around the loudspeaker system 1, 4 than higher frequencies. This is illustrated in FIG. 3 by the travels $d'_2$ for low frequencies and $d_2$ for higher frequencies. In terms of the second sound source 4, only slight effective travel differences for different frequencies appear at the cancellation location X, i.e. $d_1 \sim d'_1$.

Figure 5B:
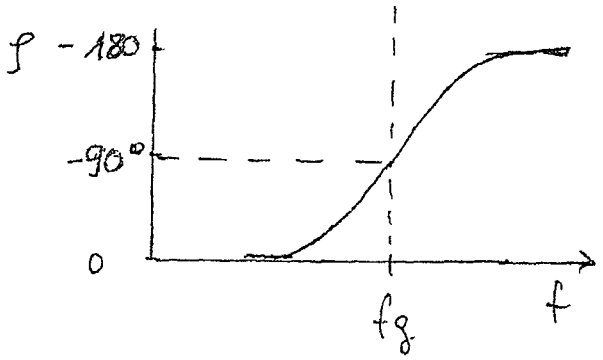
FIG. 5B shows a graph schematically showing the phase delay produced by the low-pass characteristic (FIG. 5A)

The frequency dependency of the effective travel length for the rearward sound means that it is necessary for the sound radiated by the second sound source 4 to be delayed on the basis of frequency. In line with the invention, this is likewise achieved by the audio low-pass characteristic of the second sound source 4. FIG. 5B illustrates the phase response of an audio low-pass filter using the example of a second-order low-pass filter. In the low-frequency range significantly below the cut-off frequency $f_g$, a low-pass filter behaves in practice like a constant-frequency delay element, e.g. with the delay 0. In the transition to its attenuation range, the low-pass filter exhibits an all-pass response, i.e. it behaves like a frequency-dependent delay element. For higher frequencies, a longer propagation time delay is obtained than for lower frequencies. The phase delay in a second-order low-pass filter in the range $f \gg f_g$ is −180°, the phase delay being −90° at the cut-off frequency $f_g$. When the loudspeaker system 1, 4 is tuned and designed in suitable fashion, this response allows a cardioid or hypercardioid radiation pattern to be produced without this requiring the electrical drive signal for the rear sound source 4 to be filtered. In particular, a second power amplifier channel is not required for driving the rear sound source 4.

In other words, it is possible to drive the two sound sources 1, 4 using one and the same drive signal and to allow cancellation of the rearward sound from the first sound source 1 solely by providing a second sound source 4 with an audio low-pass response and suitable tuning of the two sound sources. In this case, the audio low-pass filter firstly prompts the requisite frequency-dependent damping of the amplitude function of the "cancellation sound" radiated by the second sound source 4, and furthermore produces a suitable propagation time delay, bringing about the phase opposition of the two sound fields at the cancellation location X.

The requisite propagation time delay to ensure that the two sound fields are in phase opposition at the cancellation location X can be produced, by way of example, by using the second-order low-pass filter in the output range (i.e. in the region of the cut-off frequency $f_g$) to achieve a phase shift of −90° and producing the remaining required −90° phase shift by virtue of design measures (tuning the two sound sources 1, 4 in terms of their enclosure volumes, distance between the loudspeakers etc.).

It will be pointed out that, generally, any audio bandpass filter can be used as rear sound source 4 in an inventive loudspeaker system 1, 4 on account of its low-pass response in the region of the upper band limit.

Figure 6:
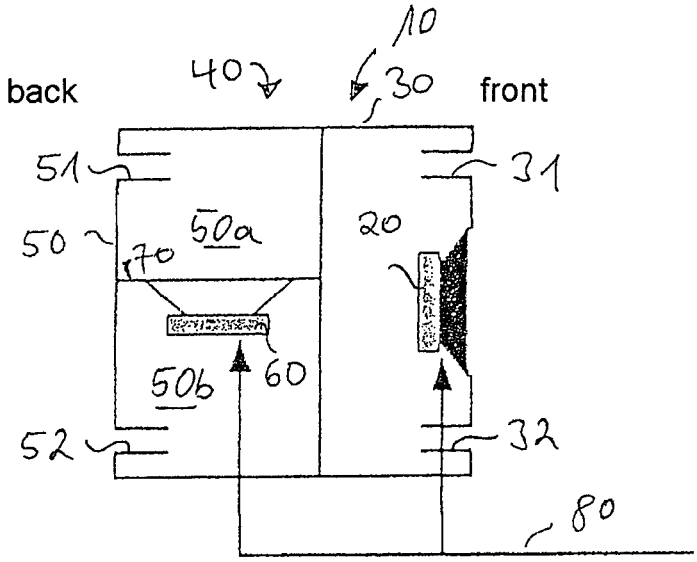
FIG. 6 shows a schematic illustration of a loudspeaker system based on a first exemplary embodiment of the invention.
Figure 7:
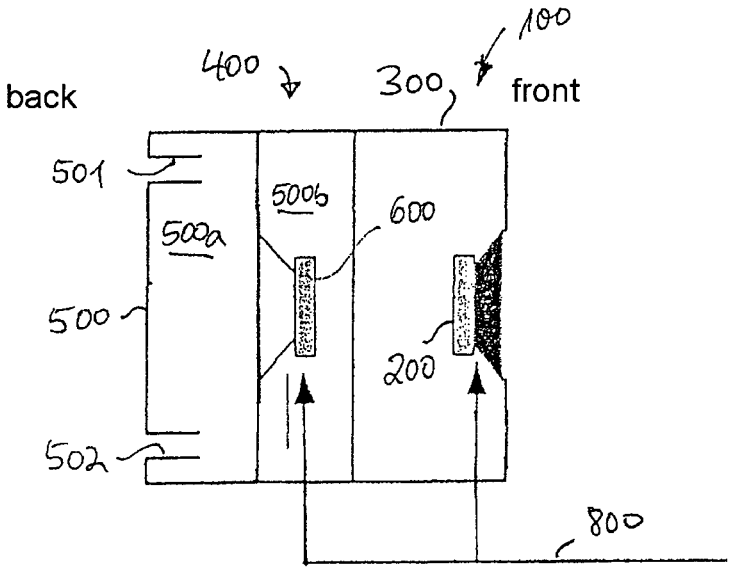
FIG. 7 shows a schematic illustration of a loudspeaker system based on a second exemplary embodiment of the invention.

FIGS. 6 and 7 show two exemplary embodiments of the present invention by way of example. The loudspeaker system shown in FIG. 6 (subwoofer system) has, as a loudspeaker 20, a bass driver which is incorporated in a first loudspeaker enclosure 30, which is not sealed but rather is connected to the outside ("vented") by one or more channels 31, 32. A loudspeaker enclosure 30 of this kind is also called a bass reflex enclosure. A bass reflex enclosure 30 implements a bass reflex resonator, which is a fourth-order audio high-pass filter.

Bass reflex enclosures allow the use of loudspeakers 20 with relatively powerful electrodynamic drives. Furthermore, the channels 31, 32 shift the resonant frequency of the enclosure 30 to a lower frequency range. This allows systems having a higher level of efficiency above the bass reflex resonator's centre frequency than in the case of closed enclosures of the same size.

The rear sound source 40 used is a bandpass enclosure 50 having a first chamber 50*a* and a second chamber 50*b*. Both the first chamber 50*a* and the second chamber 50*b* are vented, i.e. are open to the outside via a channel 51 or 52. Bandpass enclosures of this type are also called double-vented bandpass enclosures. Double-vented bandpass enclosures form an acoustic double resonator which implements a sixth-order audio bandpass filter. The second bass loudspeaker 60 is located on a partition 70 between the two chambers 50*a*, 50*b*.

Since the transfer function of a sixth-order audio bandpass filter differs from that of a fourth-order audio high-pass filter by an additional second-order audio low-pass filter (see FIGS. 5A, 5B), combining these acoustic resonators, given suitable tuning and design in terms of the proportioning of the enclosures 30, 40 and the distance between the two loudspeakers 60, 20, allows a cardioid or hypercardioid radiation pattern to be generated which is comparable to that of an actively driven second loudspeaker 60. It will be pointed out that in the case of the inventive loudspeaker system the cardioid or hypercardioid radiation pattern can be achieved using one and the same drive signal 80 for the two loudspeakers 20, 60.

FIG. 7 shows a second exemplary embodiment. The first sound source 100 is implemented by a bass loudspeaker 200 which is incorporated in a closed enclosure 300. A closed enclosure is a second-order audio high-pass filter. The rear, second sound source 400 has a bandpass enclosure 500 which comprises a first chamber 500*a* and a second chamber 500*b*. In the example shown here, the first chamber 500*a* is vented by means of two channels 501, 502, for example. The second chamber 500*b* is closed and contains a bass loudspeaker 600. Such loudspeaker enclosures are also called single-vented bandpass enclosures (since only one chamber is vented). They implement a fourth-order audio bandpass filter. On account of the front bass reflex enclosure 30, the loudspeaker system in FIG. 6 (first exemplary embodiment) can be used to achieve higher levels for the same total volumes and the same bandwidths than the loudspeaker system shown in FIG. 7 (second exemplary embodiment).

As already explained for the first exemplary embodiment (FIG. 6), the low-pass characteristic (likewise second-order low-pass filter) of the fourth-order audio bandpass filter in the region of the upper band limit achieves the requisite propagation time delay with simultaneous amplitude attenuation in line with the explanations above, and even this enclosure combination can be used, through suitable tuning of the acoustic resonators in terms of proportioning and, distance between the loudspeakers etc., to achieve the rearward sound cancellation and the desired cardioid or hypercardioid radiation pattern without additional active or passive signal processing in the drive signal for the second sound source 400. As in the case of the first exemplary embodiment, the two loudspeakers 200 and 600 can be driven by one and the same drive signal 800.

In the case of the first exemplary embodiment (FIG. 6), the resonators can also be tuned by tuning the first chamber 50*a* and the second chamber 50*b* of the second loudspeaker enclosure 50 to different resonant frequencies. The lower resonant frequency should be below the resonant frequency of the bass reflex enclosure 30. The higher resonant frequency of the bandpass resonator is then chosen in suitable fashion in order to set the desired low-pass response.

In the case of the second exemplary embodiment shown in FIG. 7, tuning the resonant frequency of the bandpass enclosure 500 likewise allows the low-pass response (cut-off frequency) of the audio bandpass filter to be influenced as desired.

In addition to the combination options shown in FIGS. 6 and 7 for resonators, inventive loudspeaker systems having further resonator combinations can be provided:

- loudspeaker system having a front closed enclosure (2nd order high pass filter) and a rear 6th order bandpass enclosure (e.g. double vented double chamber bass reflex enclosure);
- loudspeaker system having a front bass reflex enclosure (4th order high pass filter) and a rear 4th-order bandpass enclosure (e.g. single vented double chamber bass reflex enclosure);
- loudspeaker system having a front fourth order bandpass enclosure (e.g. single vented double chamber bass reflex enclosure) and a rear 6th order bandpass enclosure (e.g. double vented double chamber bass reflex enclosure);
- loudspeaker system having a front 6th order bandpass enclosure (e.g. double vented double chamber bass reflex enclosure) and a rear enclosure of the same type (i.e. likewise a 6th order bandpass enclosure).

The resonator combinations mentioned in the listing above are in practice at least in part more difficult to proportion than the resonator combinations described with reference to FIGS. 6 and 7 but likewise allow suppression of the rearward sound in line with the inventive procedure given suitable design/proportioning.

It will be pointed out that suitable tuning of the cited acoustic resonators allows both a cardioid and a hypercardioid radiation characteristic to be achieved. In addition, the distance of the cancellation location X can be influenced and stipulated by the tuning. In this context, account should be taken of the fact that the frequency dependency of the travel delay at a desired cancellation location X means that essentially complete cancellation (phase delay 180°) occurs only for a particular frequency. In practice, however, it is possible to have a phase delay of >120° occur at this cancellation location X for all frequencies in the operating range. This ensures that the cancellation location X never experiences a signal increase but rather always—at least in part—cancellation of the sound.

In many cases, a cancellation location X in the range from 3 to 15 m behind the loudspeaker system will be advantageous, since this range contains the microphones on a stage, for example. Alternatively, a cancellation location X at a greater distance (e.g. at infinity) may be chosen.

Figure 8:
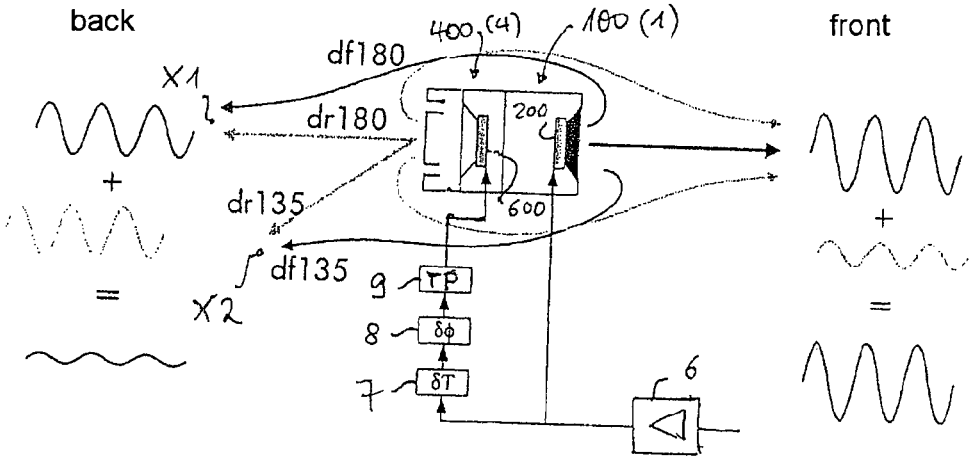
FIG. 8 shows a schematic illustration of an inventive loudspeaker system with electrical signal preprocessing.
Figure 9:
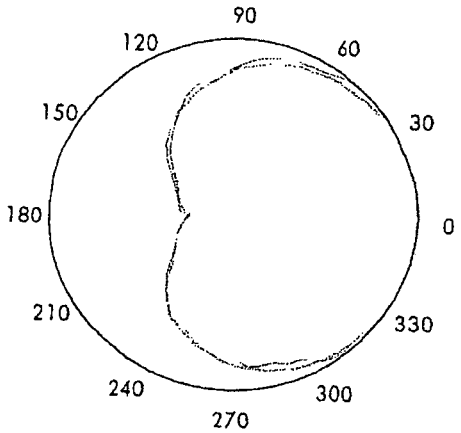
FIG. 9 shows a polar diagram to illustrate a cardioid radiation characteristic.
Figure 10:
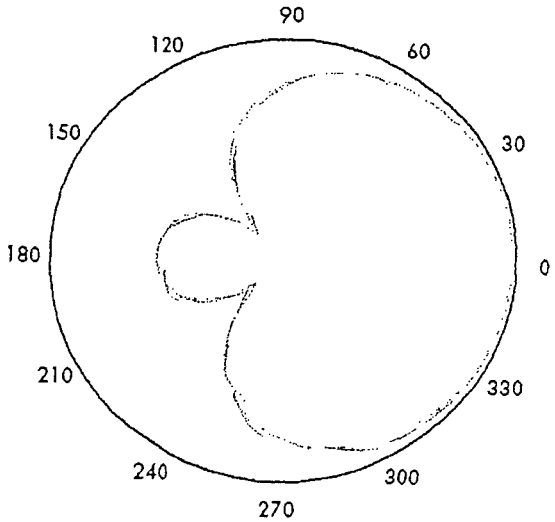
FIG. 10 shows a polar diagram to illustrate a hypercardioid radiation characteristic.

FIG. 8 illustrates the tuning of an inventive loudspeaker system to a cardioid or a hypercardioid radiation pattern. If the frequency and phase response of the rear sound source 4 is tuned to the wavelength difference $\Delta 1=(df180-dr180)$, a cancellation location X.1 and accordingly a cardioid radiation pattern are obtained, as illustrated in the polar diagram in FIG. 9. If the frequency and phase response of the rear sound source 4 is tuned to the wavelength difference $\Delta 1=(df135-dr135)$, a cancellation location X2 and accordingly a hypercardioid radiation pattern are obtained, as illustrated in the polar diagram in FIG. 10. In this case, $df\alpha$ denotes the wavelength between the first sound source 1 (100) and the cancellation location X1 or X2, and $dr\alpha$ denotes the wavelength between the second sound source 4 (400) and the cancellation location X1 or X2, in each case for an angle $\alpha$ between the main radiation direction to the front and the respective cancellation location X1 or X2. The loudspeaker system shown in FIG. 8, comprising the resonator arrangement 100, 400, is merely an example and may be replaced, by way of example, by the loudspeaker system 10, 40 in the first exemplary embodiment (FIG. 6) or by another loudspeaker system 1, 4 involving the inventive principles.

As already mentioned, the inventive loudspeaker system 1, 4 allows a cardioid or hypercardioid radiation pattern to be obtained merely through suitable adjustment of the design of the resonators 1, 4 in terms of enclosure types, enclosure dimensions, distance between the loudspeakers etc., without providing different signal processing for the loudspeakers on the two sound sources 1, 4. Further influencing variables which have not yet been mentioned up until now are the relative polarity of the two loudspeakers 20, 60 and 200, 600 and their installation direction (these two influencing variables are dependent on one another). However, the invention also allows the phase response and level profile of the second sound source 4 to be altered by means of suitable measures in the drive path. This allows the variability of the system to be increased, since, by way of example, it is possible to change between a cardioid and a hypercardioid radiation pattern. In FIG. 8, a common amplifier channel 6 is used to drive the two loudspeakers 200, 600. The drive path for the second loudspeaker 600 for producing the "cancellation sound" optionally contains a delay element 7, a phase shifter 8 and an (electrical) low-pass filter 9. The time delay $\delta t$ of the delay element, the phase offset $\delta\phi$ of the phase shifter 8 and the filter coefficients of the low-pass filter 9 may be variable. The cited components 7, 8 and 9 may be passive electrical components. They allow additional tuneability for the inventive loudspeaker system 1, 4, permitting the cardioid or hypercardioid radiation pattern, stipulated by the design, of the loudspeaker system 1, 4 to be altered "retrospectively" or to be adjusted to suit different conditions of use.

It is also possible to drive the inventive loudspeaker system 1, 4 using two separate amplifier channels, in which case the audio low-pass filter provided in line with the invention means that now only relatively slight signal shaping or signal distortion of the electrical drive signal for the second, rear loudspeaker is required. Like the passive electrical components, the second amplifier channel can also be used for retrospectively altering the cardioid or hypercardioid radiation characteristic produced by the design.

In addition, an inventive loudspeaker system may have a plurality of loudspeakers both for the first sound source 1 and for the second sound source 4. One implementation option involves a respective plurality of loudspeakers being accommodated in the enclosure 3 and/or the enclosure 5. An inventive loudspeaker system may also be designed in the form of an array comprising individual loudspeaker systems of the type described hitherto with two respective loudspeaker enclosures. In this case, the reference symbol 3 in FIG. 3 denotes a first array of loudspeaker enclosures arranged at the front, and the reference symbol 5 denotes a second array of loudspeaker enclosures arranged at the rear. Such arrays form, as it were, scaleable acoustic resonators to which the above considerations and implementation options can be applied in similar fashion.

The invention claimed is:

1. A loudspeaker system comprising:

a front loudspeaker enclosure having at least one first loudspeaker, the front loudspeaker enclosure having a closed rear wall; and a rear loudspeaker enclosure arranged at the rear wall of the front loudspeaker enclosure and having at least one second loudspeaker, wherein the rear loudspeaker enclosure is a bandpass enclosure, and the first loudspeaker and the second loudspeaker are operated by a same drive signal, and the loudspeaker system has a cardioid radiation pattern or a hypercardioid radiation pattern, and the frequency response, arising at a listening location at the rear of the loudspeaker system, of the sound source formed from the bandpass enclosure with the second loudspeaker is in tune with the frequency response, arising at the listening location, of the sound source formed from the front loudspeaker enclosure with the first loudspeaker such that the two frequency responses essentially match in the low-pass range of the bandpass filter.

2. A loudspeaker system according to claim 1, wherein the loudspeaker system is a bass loudspeaker system.

3. A loudspeaker system according to claim 1 or 2, wherein the rear loudspeaker enclosure is an at least double-vented bandpass enclosure.

4. A loudspeaker system according to claim 1 or 2, wherein the rear loudspeaker enclosure is a single-vented bandpass enclosure.

5. A loudspeaker system according to claim 1, wherein the front loudspeaker enclosure is a high-pass enclosure.

6. A loudspeaker system according to claim 5, wherein the front loudspeaker enclosure is a vented high-pass enclosure.

7. A loudspeaker system according to claim 5, wherein the front loudspeaker enclosure is a closed high-pass enclosure.

8. A loudspeaker system according to claim 1 or 2, wherein the two loudspeaker enclosures are physically in tune with one another such that the phase response, arising at a listening location at the rear of the loudspeaker system of the sound source formed from the bandpass enclosure with the second loudspeaker is shifted, at a particular frequency, essentially 180° relative to the phase response, arising at the listening location, of the sound source formed from the front loudspeaker enclosure with the first loudspeaker.

9. A loudspeaker system according to claim 1, wherein the listening location is 3 to 15 meters behind the loudspeaker system.

10. A loudspeaker system according to claim 1 or 2, further comprising an amplifier which has a common amplifier channel to produce the drive signal for the first loudspeaker and the drive signal for the second loudspeaker.

11. A loudspeaker system according to claim 1 or 2, wherein the drive signal for the second loudspeaker is produced from the drive signal for the first loudspeaker by signal processing by passive electrical components.

12. A loudspeaker system comprising:

a front loudspeaker enclosure having at least one first bass loudspeaker, the front loudspeaker enclosure being a high-pass enclosure and having a closed rear wall; and a rear loudspeaker enclosure having at least one second bass loudspeaker, the rear loudspeaker enclosure being a bandpass enclosure and being separated from the front loudspeaker enclosure, wherein the loudspeaker system has a cardioid radiation pattern or a hypercardioid radiation pattern, a frequency response produced by the bandpass enclosure has a low-pass transmission range that essentially matches a frequency response produced by the high-pass enclosure at a listening location at a rear of the loudspeaker system, the rear loudspeaker enclosure is a bass reflex enclosure which has at least two chambers, the second bass loudspeaker is located on a partition between the at least two chambers, and the rear loudspeaker enclosure includes a closed chamber and a bass reflex chamber or two bass reflex chambers.

13. A loudspeaker system according to claim 1 or 12, wherein the front loudspeaker enclosure is a bass reflex enclosure.

14. A loudspeaker system according to claim 13, wherein the front loudspeaker enclosure is a closed enclosure.

15. A loudspeaker system according to claim 13, wherein the rear loudspeaker enclosure comprises two bass reflex chambers, and the resonant frequency of one bass reflex chamber in the rear loudspeaker enclosure is lower than the resonant frequency of the front loudspeaker enclosure.

16. A loudspeaker system according to claim 13, wherein the two loudspeaker enclosures are physically in tune with one another such that the phase response, arising at a listening location at the rear of the loudspeaker system, of the second sound source formed from the rear loudspeaker enclosure with the second bass loudspeaker is shifted, at a particular frequency, essentially 180° relative to the phase response, arising at the listening location, of the first sound source formed from the front loudspeaker enclosure with the first bass loudspeaker.

17. A loudspeaker system according to claim 16, wherein the listening location is chosen to be 3 to 15 meters behind the loudspeaker system.

18. A loudspeaker system according to claim 13, further comprising an amplifier which has a common amplifier channel to produce the drive signal for the first bass loudspeaker and the drive signal for the second bass loudspeaker.

19. A loudspeaker system according to claim 13, wherein the drive signal for the second bass loudspeaker is produced from the drive signal for the first bass loudspeaker by signal processing by passive electrical components.

20. A loudspeaker system comprising:

a front loudspeaker enclosure containing at least one first loudspeaker, the front loudspeaker enclosure being a high-pass enclosure and being enclosed at a rear wall thereof; and a rear loudspeaker enclosure arranged at the rear wall of the front loudspeaker enclosure and containing at least one second loudspeaker, the rear loudspeaker enclosure being a bandpass enclosure, wherein the loudspeaker system has a cardioid radiation pattern or a hypercardioid radiation pattern, a frequency response produced by the bandpass enclosure has a low-pass transmission range that essentially matches a frequency response produced by the high-pass enclosure at a listening location at a rear of the loudspeaker system, and the rear loudspeaker enclosure has at least two chambers, the at least one second loudspeaker is located on a partition wall between the at least two chambers, and a radiation direction of the second loudspeaker Is perpendicular to the rear direction.

21. A loudspeaker system comprising:

a front loudspeaker enclosure having at least one first loudspeaker, the front loudspeaker enclosure having a closed rear wall; and a rear loudspeaker enclosure arranged at the rear wall of the front loudspeaker enclosure and having at least one second loudspeaker, wherein the rear loudspeaker enclosure is a bandpass enclosure, and the first loudspeaker and the second loudspeaker are operated by a same drive signal, the loudspeaker system has a cardioid radiation pattern or a hypercardioid radiation pattern, and the two loudspeaker enclosures are physically in tune with one another such that the phase response, arising at a listening location at the rear of the loudspeaker system of the sound source formed from the bandpass enclosure with the second loudspeaker is shifted, at a particular frequency, essentially 180° relative to the phase response, arising at the listening location, of the sound source formed from the front loudspeaker enclosure with the first loudspeaker.

* * * * *

UNITED STATES PATENT AND TRADEMARK OFFICE

CERTIFICATE OF CORRECTION

PATENT NO. : 8,842,866 B2
APPLICATION NO. : 12/000104
DATED : September 23, 2014
INVENTOR(S) : Matthias Christner It is certified that error appears in the above-identified patent and that said Letters Patent is hereby corrected as shown below:

In the Claims

Column 9, Line 11, In Claim 1, after “signal,” delete “and”.

Signed and Sealed this
Seventh Day of April, 2015

Michelle K. Lee

Michelle K. Lee
*Director of the United States Patent and Trademark Office*